US005636384A

United States Patent [19]

Draughon et al.

[11] Patent Number: 5,636,384

[45] Date of Patent: Jun. 10, 1997

[54] HEADBAND AND BOW COMBINATION

[76] Inventors: Bonnie Draughon, 1106 N. Gilbert Rd., #2112, Mesa, Ariz. 85203; Shelle Soelberg, 3210 E. Main St., Mesa, Ariz. 85213

[21] Appl. No.: 472,129

[22] Filed: Jun. 7, 1995

[51] Int. Cl.[6] ..... A41D 20/00

[52] U.S. Cl. ..... 2/171; 2/151; 2/209.11; 2/DIG. 11

[58] Field of Search ..... 2/144, 151, 154, 2/156, 171, 207, 209.11, 209.13, 244, 300, DIG. 11; 132/275; 223/46; 428/4, 5

[56] References Cited

U.S. PATENT DOCUMENTS

| | | | |
|---|---|---|---|
| 143,702 | 4/1873 | Baxter . | |
| 343,508 | 1/1886 | Jones . | |
| 1,287,626 | 4/1918 | Brett . | |
| 1,873,333 | 8/1932 | Samphere | 2/151 |
| 2,105,436 | 1/1938 | Flatto . | |
| 2,488,954 | 3/1949 | Winters . | |
| 2,578,269 | 10/1951 | Sinton . | |
| 3,034,134 | 12/1962 | Peterson . | |
| 3,542,041 | 11/1970 | Mercorella . | |
| 5,144,696 | 9/1992 | Kahl . | |

*Primary Examiner*—Diana Biefeld
*Attorney, Agent, or Firm*—Steven L. Nichols

[57] ABSTRACT

This invention is a headband and bow combination where the bows can be changed to create different looks. The headband has an over-hand knot tied in it, which may be loosened to receive a bow and then tightened to hold the bow in place. The headband is of an expandable material and the wearing of the headband around the user's head serves to maintain the knot in its tightened condition and correspondingly maintain the bow in place.

12 Claims, 1 Drawing Sheet

HEADBAND AND BOW COMBINATION

FIELD OF THE INVENTION

Generally this invention relates to apparel, more specifically, this invention is a headband having a knot and a bow removably secured within the knot.

BACKGROUND OF THE INVENTION

Historically, the bow has served both the purposes of fashion and utility for an almost uncountable number of years. Furthermore, perhaps due to the simplicity of the bow, or its neat, crisp appearance, or the various colors and color combinations, the bow in one form or another appears never to be out of style. From large, fanciful bows on an evening gown, to the black bow tie worn with a tuxedo, the styles, uses and methods of attachment are myriad.

The bow in probably its most simple form is in fact a type of a knot tied in such a manner that wings extend outwardly from each side of the knot, thereby forming the decorative bow. This approach is similar whether one is tying a bow on a pair of shoelaces, a bow tie or a bow in a sash. In addition, numerous inventions and products exist where a bow is attached to an item in any one of a variety of fashions.

Relative to the modes of attachment, some bows are sewn directly to a garment, while others are fastened to a body-encircling member or band. In this latter category, the bow may be stitched to the band or an additional strip of material may secure the band and bow together as is shown in the patents to Peterson, U.S. Pat. No. 3,034,134 and to Sinton, U.S. Pat. No. 2,578,269.

In some patents, such as that issued to Sinton, the color of the bow can be changed. In the Sinton patent, this is accomplished by using stiffeners with different designs within the transparent wings of the bow tie.

While numerous configurations exist, there is still the need for a more simple, yet versatile bow. A bow more suited for use by infants and toddlers is also needed.

SUMMARY OF THE INVENTION

This invention is a combination of a headband and a bow. The headband is a continuous piece of material with its ends sewn together and a knot tied at a predetermined place along its length. The knot can be loosened and a bow can be inserted behind the frontpiece of the knot, afterwhich the knot can be tightened to securely hold the bow in place. In this way, the crosspiece of the bow is located within the knot, behind the frontpiece, and the wings of the bow extend outwardly from either side of the knot.

In order to accomplish this, the headband must be between 0.5 inches and 2.0 inches in width and the material must be of sufficient weight or density to enable the knot to be easily tightened and loosened.

The standard used in the industry for determining the density of material is measured in ounces per yard, with a yard being a piece of material thirty-six inches in length and sixty inches in width. In the subject invention, the material to be used must be between six and thirteen ounces per yard in order to obtain the proper functioning of the knot as it relates to receiving and holding the bow.

The length of material used to make the band is preferably sixteen to twenty-two inches with the preferred length being twenty inches. Once a knot is tied in the band, the final circumference is about seventeen inches with the knot taking up approximately three inches of material. This size is generally suitable to be worn around the heads of infants up to about two-and-one-half years old, assuming that the material being used is expandable. Our preferred choice of material is SPANDEX or LYCRA (LYCRA is a registered trademark of DuPont Corporation), as it provides a soft feel to the child and generally expands to the necessary sizes without excessive constrictions. The preferred LYCRA is actually a blend of ten per cent LYCRA and ninety per cent cotton.

The headband may be easily made by cutting the material to its desired length, folding it in half lengthwise and sewing it together to obtain the necessary thickness. A knot is then tied in the material and the ends of the material are sewn together to form a band. Because of the thickness of the material, the knot may be easily moved and adjusted to form a substantially vertical frontpiece. The bow is slipped behind the frontpiece and then the knot is tightened sufficiently to hold the bow in place. The crosspiece of the bow is placed under the frontpiece of the knot, with the lengths of the bow extending outwardly from either side of the frontpiece.

It should be appreciated that when the stretchable headband is placed around the child's head, the expandability of the material creates additional tension on the knot, thereby holding the bow in place. Should one wish to change the bow, this can be easily accomplished by simply removing the headband and loosening the knot, afterwhich the bow may be easily withdrawn and the new bow inserted. After the bow is inserted, the knot is once again tightened and the headband placed around the child's head.

DETAILED DESCRIPTION OF THE DRAWINGS

Figure 1:
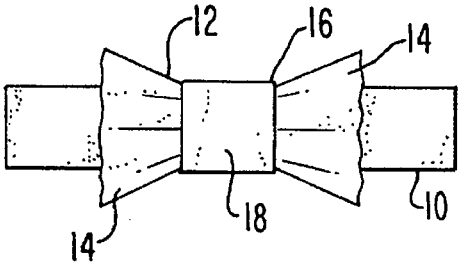
FIG. 1 is a front-elevational view of the invention with the bow inserted within the knot of the headband.
Figure 3:
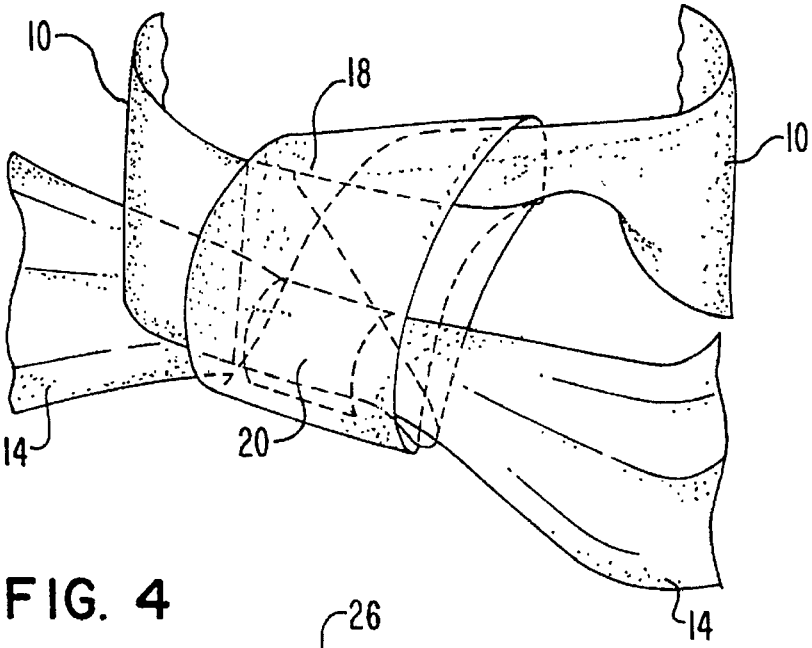
FIG. 3 is a perspective view showing the knot in its expanded or loosened state and the placement of the bow therein.

FIG. 1 discloses the headband 10 with the attached bow 12. The wings 14 of bow 12 extend outwardly from the knot 16 which is tied in the headband 10. The preferred type of knot is an over-hand knot. The frontpiece 18 of the over-hand knot covers the central crosspiece of a bow as shown more clearly in FIG. 3. FIG. 3 also shows the bow 12 of the present invention comprising two wings 14 with the crosspiece 20 being a piece of material wrapped around the center of the bow 12 from which the two wings 14 extend.

Figure 2:
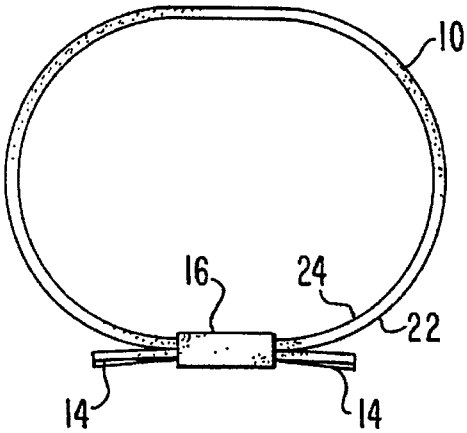
FIG. 2 is a top plan view of the headband and bow combination.

As shown in FIGS. 2 and 3, the headband 10 is a single continuous strip of material, having a first end 22 and a second end 24 which are sewn together after the over-hand knot 16 is tied.

Figure 4:
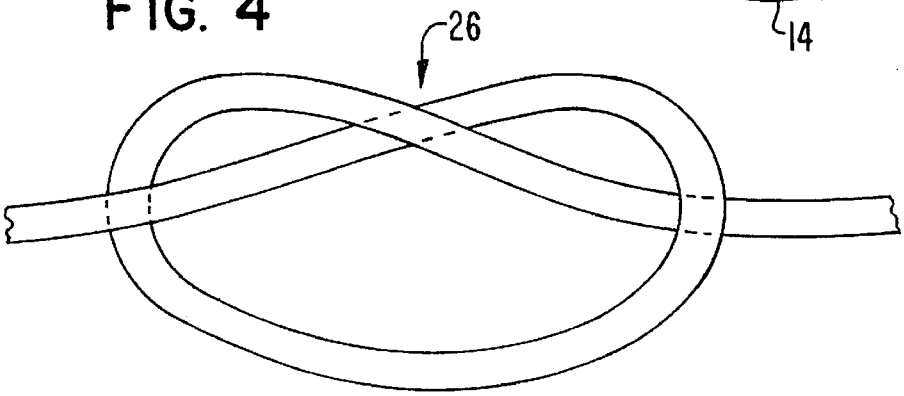
FIG. 4 is an illustrative view of an over-hand knot.

The over-hand knot, as shown in FIG. 4, is simply made by crossing the strip as shown at 26, FIG. 4, and then folding one strip over the other strip and directing an end through the loop which has been formed. When this is performed with a wider and more dense material, a frontpiece 18 as shown in FIG. 3, can be formed. Due to the width and density of the material, the knot 16 is easy to loosen or tighten as desired. Accordingly, a user can loosen the knot 16 and insert the bow 12 within the knot such that the crosspiece 20 lies behind the frontpiece 18 of the headband. The knot is then drawn tight and the headband is placed around the head.

While the above describes the preferred embodiment of the subject invention, it should be appreciated that variations may be made without departing from the actual invention, the scope of which is intended to be limited only by the appended claims.

We claim:

1. A headband and bow combination comprising:

a strip of material having a first end and a second end, said first and second ends being secured together, said strip having at least one knot tied in it, such that the strip from the first end, along its length, including the knot, and to the second end, is continuously connected material, said strip being of a preselected width and weight so as to allow for the relatively easy loosening of the knot; and at least one bow having a crosspiece comprising material wrapped around said bow from which wings extend outwardly, wherein said bow may be inserted into the knot, such that the crosspiece lies within the knot.

2. The headband and bow combination of claim 1 wherein the strip of material is expandable.

3. The headband and bow combination of claim 2 wherein the strip has a predetermined length, width and weight per yard, and said width is between 0.5 inches and 2.0 inches.

4. The headband and bow combination of claim 3 wherein the weight per yard of said material is between six and thirteen ounces per yard, wherein a yard of said material is thirty-six by sixty inches.

5. The headband and bow combination of claim 4 wherein the length of the material is between sixteen and twenty-two inches.

6. The headband and bow combination of claim 1 wherein the knot is an over-hand knot.

7. The headband and bow combination of claim 1 wherein said crosspiece secures said wings such that said bow retains its shape when removed from said knot.

8. The headband and bow combination of claim 1 wherein said combination further comprises a plurality of bows each having a crosspiece and outwardly extending wings extending from said crosspiece, wherein each said bow may be inserted into the knot.

9. A headband and bow combination comprising:

a strip of material having a first end and a second end, said first and second ends being sewn together, said strip having at least one knot tied in it, such that the strip, from the first end, along its length, including the knot, and to the second end, is continuously connected material; and a bow having a crosspiece comprising material wrapped around said bow from which wings extend outwardly, wherein said bow may be inserted into the knot, such that the crosspiece lies within the knot and said knot holds said bow.

10. A headband and bow combination comprising:

a strip of material having a first end and a second end, said first and second ends being secured together, said strip having at least one knot tied in it, such that the strip from the first end, along its length, including the knot, and to the second end, is continuously connected material; and a bow having outwardly extending wings;

wherein said bow may be inserted into the knot, such that said knot holds said bow;

and further wherein said knot comprises expandable material.

11. The headband and bow combination of claim 10 wherein substantially all of said strip is made from an expandable material.

12. The headband and bow combination of claim 10 wherein said strip comprises two layers of material which are stitched together.

* * * * *